US005869795A

United States Patent [19]

Miyazawa et al.

[11] Patent Number: 5,869,795

[45] Date of Patent: Feb. 9, 1999

[54] ELEVATOR FLOOR ARRIVAL CORRECTION CONTROL

[75] Inventors: Hideki Miyazawa, Kawasaki; Koji Yamada, Nishikasugaigun, both of Japan

[73] Assignee: Otis Elevator Company, Farmington, Conn.

[21] Appl. No.: 963,423

[22] Filed: Nov. 3, 1997

[30] Foreign Application Priority Data

Nov. 7, 1996 [JP] Japan ..... 8-294686

[51] Int. Cl.[6] ..... B66B 1/40

[52] U.S. Cl. ..... 187/291; 107/393; 107/284

[58] Field of Search ..... 137/282, 284, 137/291, 393, 394

[56] References Cited

U.S. PATENT DOCUMENTS 4,337,846 7/1982 Yonemoto et al. ..... 187/284

4,470,482 9/1984 Husson ..... 187/295

4,976,338 12/1990 Holland ..... 187/285

FOREIGN PATENT DOCUMENTS 2-62383 3/1990 Japan .

*Primary Examiner*—Robert E. Nappi

[57] ABSTRACT

An elevator is provided with floor arrival correction control which monitors the elapsed time following completion of the previous floor arrival correction. If the time elapsed is less than a fixed time (102), the elevator car is controlled with a standard floor arrival control speed pattern (103, 52), if it is greater than the fixed time, the next floor arrival-corrected operation is compared with the direction of operation for the previous correction (104). If the same, the car has not yet arrived in the door zone (e.g., because the car is heavily loaded) and the car is controlled with an increased speed pattern (105, 51). If not the same, the car has overrun the door zone and it is controlled with a reduced speed pattern (106, 53).

6 Claims, 5 Drawing Sheets

ELEVATOR FLOOR ARRIVAL CORRECTION CONTROL

TECHNICAL FIELD

The present invention pertains to elevator floor arrival correction, and more particularly to floor arrival correction without use of a speed detector.

BACKGROUND OF THE INVENTION

It is well known that an elevator system, such as that shown in FIG. 1, comprises a controller (10) which drives an induction motor IM which drives a sheave (33). An elevator car (35) and a counterweight (36), are connected on opposite ends of a rope (34) engaged on the drive sheave (33). Usually, the weight of the counterweight (36) is selected appropriately so that it can balance a load of 40–60% of the nominal weight in the car. It is capable of reducing the maximum torque generated by the induction motor over the entire range from zero to maximum of the internal load of the car.

Referring to FIG. 2, a schematic block diagram of the elevator controller (10) without a speed detector, is shown. In particular, a known inverter circuit (2) drives the induction motor IM. AC input voltage is provided from an AC source (11) to an AC-to-DC converter 1 which converts the AC input voltage to a DC voltage which is provided across the inverter (2). A DC voltage detector (3) detects the DC voltage across the inverter circuit (2) and provides a signal indicative of the DC voltage to an A/D converter (4) and a voltage comparator.(7). The AID converter (4) converts the DC voltage to a digital signal, which is input to a control circuit or CPU (15) (which may be part of a larger control circuit or computer) for controlling the output voltage Vs to the inverter (2), as is known (details not shown and not critical to the present invention).

Also, a known regenerative power consumption circuit (8) is connected across the inverter (2). When the DC voltage across the inverter rises due to the feedback power from motor IM as the inverter enters the regenerative mode, this voltage rise is compared against a standard voltage Vd and is detected by the comparator (7) and, through drive circuit (9), the switching element of the power consumption circuit (8) is controlled and the regenerative power is consumed by resistor R1, as is known.

A frequency operation circuit (12) receives a speed command SP from a control logic 22 (discussed hereinafter) and performs a frequency calculation and provides a frequency command Fs which is provided to a frequency/voltage converter (13). The converter (13) provides an output voltage command Vs in the form of a PWM waveform indicative of the frequency command Fs. The voltage-command Vs is provided to a drive circuit (6) which drives the inverter circuit (2). The inverter circuit (2) drives the motor IM, and the elevator is operated according to the speed command (SP).

A floor arrival correction (or "re-arrival") controller (21) comprises an edge detector (23) which detects the edge of up/down door zone signals DZU, DZD (discussed hereinafter with FIG. 3) and provides detected results DZU1, DZD1 to a door zone/floor arrival control operation unit (22). The control unit (22) may contain a CPU (5) for performing some of all of the functions of the unit (22) described herein. The CPU (5) may be part of or the same as the CPU (15) described hereinbefore. The control unit (22) provides the speed command signal SP to the frequency operation circuit (12).

Referring to FIG. 3, an example of a three-floor building with door-zone sensors is shown. On each floor, a door zone sensor for upward movement (DZU) and a door zone sensor for downward movement (DZD) are arranged and provide the aforementioned DZU,DZD signals, respectively. The door zone sensors DZU,DZD are arranged offset vertically with respect to the floor position, and they also have an overlapped portion. Consequently, when the both outputs DZU, DZD are "on" (at the overlap region or "door zone"), the arrival of the car is within the prescribed error with respect to the floor position.

When, due to variation in the load in the car, e.g., due to jumping of passengers or due to entering/exiting of passengers, etc., the outputs of the two door zone sensors DZU, DZD may fail to arrive at the overlapping site at the time when the-elevator completes deceleration. In that case, the floor arrival correction (or "re-arrival") operation profile (or pattern) which is preset in the door zone/floor arrival control unit (22) is begun to perform operation for floor arrival correction.

In conventional door zone/floor arrival control operation, the direction of movement of the car is determined by the output states of the DZU and DZD door zone sensors, and the aforementioned preset floor arrival operation pattern is begun to perform floor arrival correction control. A conventional speed pattern of floor arrival is controlled as shown in FIG. 7. In particular, the direction of elevator movement, up or down, is determined from the output states of the two sensors DZU and DZD. At the point in time when both outputs of DZU and DZD sensors are on, deceleration is begun, and control is executed such that the stop position is at the central position in the door zone. In the case shown in FIG. 3, control is executed so that the car runs 15 mm after the point in time when both DZU and DZD sensors are on.

However, as the system has no speed sensor (and the system is thus in open loop operation), even when the operation pattern is started, the car may be not driven to move when the load is heavy. In this case, the frequency of the speed pattern shown in FIG. 7 may be preset to a high speed such that operation can be made even under the heaviest load. However, in that case, if the load becomes light, even when both outputs of DZU and DZD sensors are on and deceleration is begun, the car may still overrun the door zone (due to the high speed). When it is in this mode, if the position is to be corrected again, movement has to be performed in the opposite direction, and the floor arrival correction is performed repeatedly.

This problem may be solved by performing car speed detection and speed control according to whether it is a light load or heavy load, respectively. However, such a solution requires a speed detector which increases the cost of the elevator.

DISCLOSURE OF THE INVENTION

Objects of the present invention include provision of an elevator controller which can perform floor arrival correction irrespective of the weight of the load in the elevator car without using a speed detector.

According to the present invention, elevator floor arrival correction control comprises: a) controlling the elevator with a first floor arrival correction speed pattern until a predetermined wait time has elapsed; b) controlling the elevator with a second floor arrival correction speed pattern when the direction required for floor correction is the same as in the previous floor arrival correction; c) controlling the elevator with a third floor arrival correction speed pattern when the direction required for floor correction is not the same as in the previous floor arrival correction; and repeating above steps b) and c) successively until the elevator is in a door zone at the destination floor.

According further to the present invention, the second speed pattern controls the elevator at a faster speed than the first speed pattern and the third speed pattern controls the elevator slower than the first speed pattern.

Thus, upon detection that the car has not reached the door zone after the prescribed time from the start of the floor arrival correction operation (e.g., because the car is heavily loaded), the car is driven with an increased speed pattern, and the car with a heavy load is driven to move; and upon detection that the car has overrun the door zone, the speed pattern is reduced. In this way, reliable car arrival correction control can be realized.

The present invention allows the position of the car to be controlled without using a speed detector, thereby saving cost in the elevator system. Also, the present invention allows floor arrival correction (or "re-arrival") to be completed in two rounds irrespective of the load even without a speed detector. Further, the invention allows setting of the various adjustment amounts and judgment values, e.g., time thresholds and speed patterns, so that it is possible to adjust to the optimum value corresponding to the state of the system. Consequently, general purpose applicability is high.

BEST MODE FOR CARRYING OUT THE INVENTION

Figure 1:
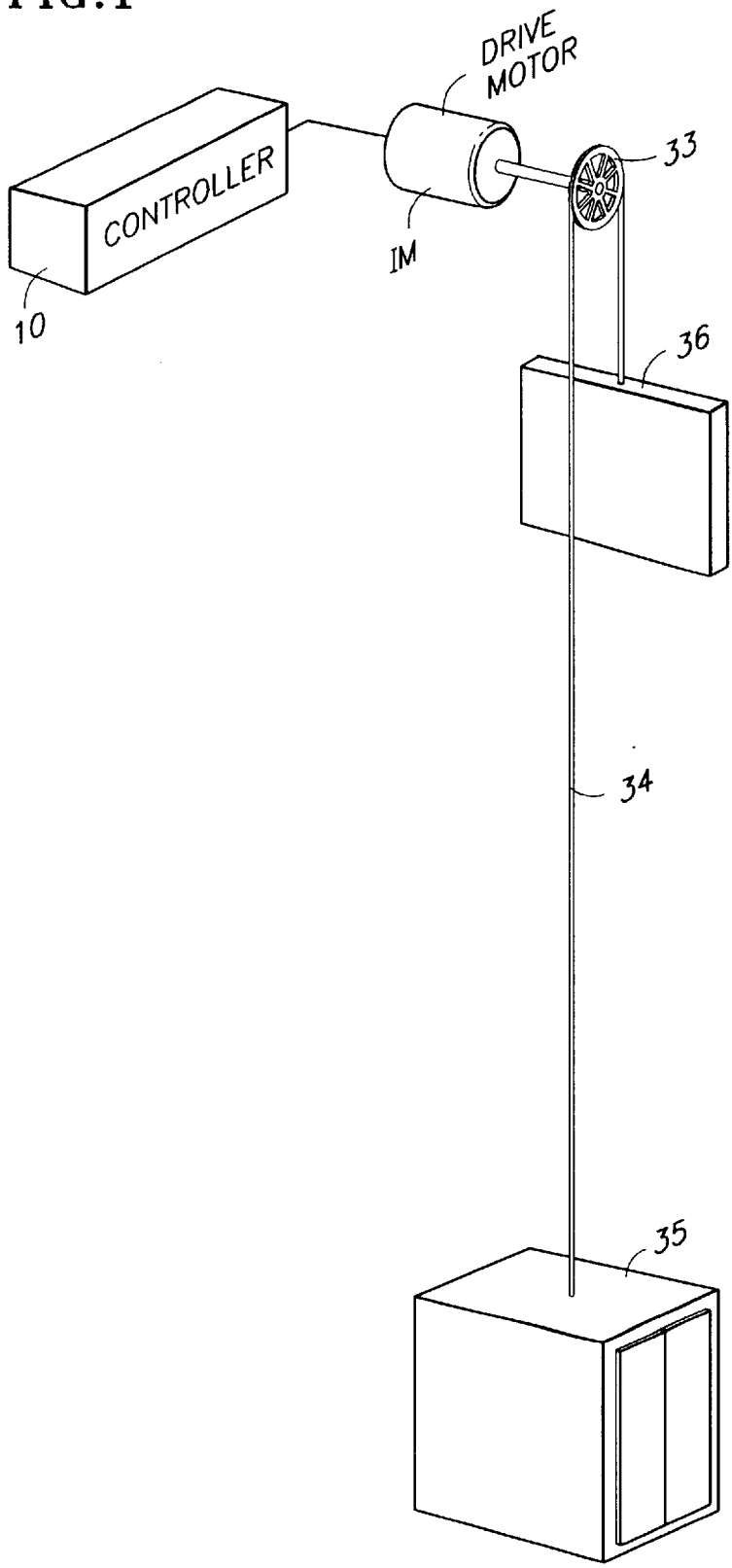
FIG. 1 is a diagram illustrating a prior art elevator system.
Figure 2:
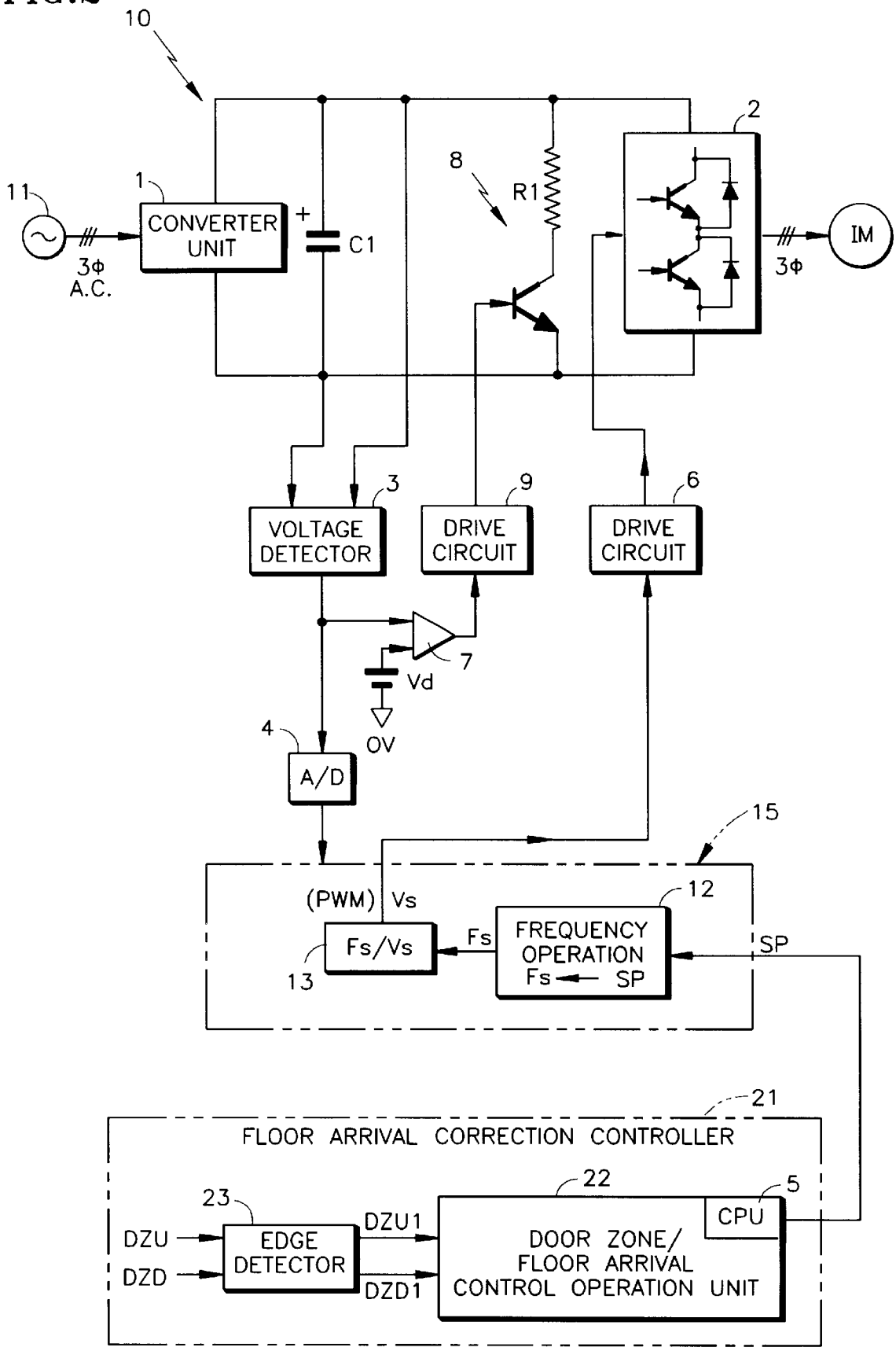
FIG. 2 is a circuit block diagram illustrating an elevator controller, in accordance with the present invention.
Figure 3:
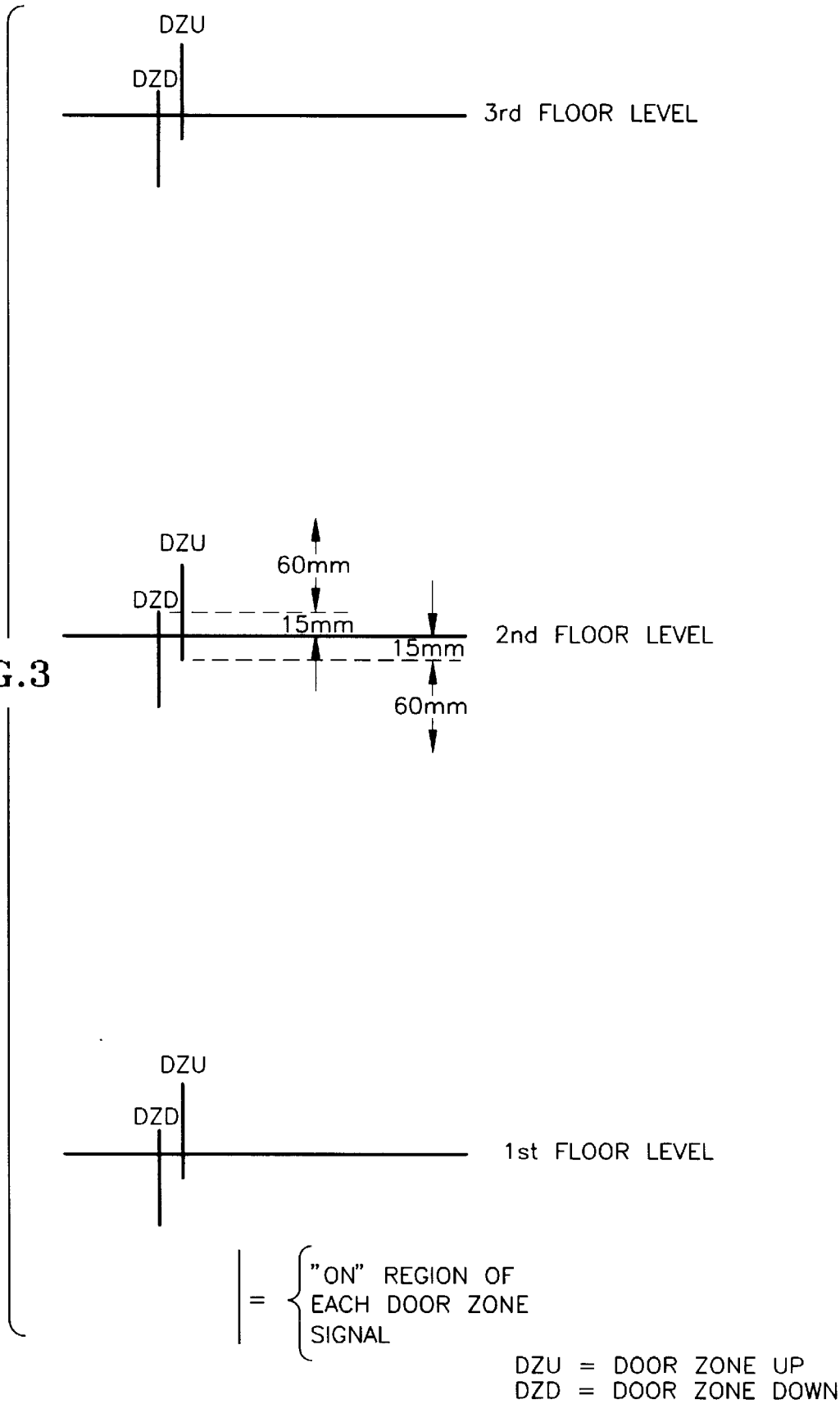
FIG. 3 is a diagram illustrating door zone signals on various floors, in accordance with the present invention.
Figure 4:
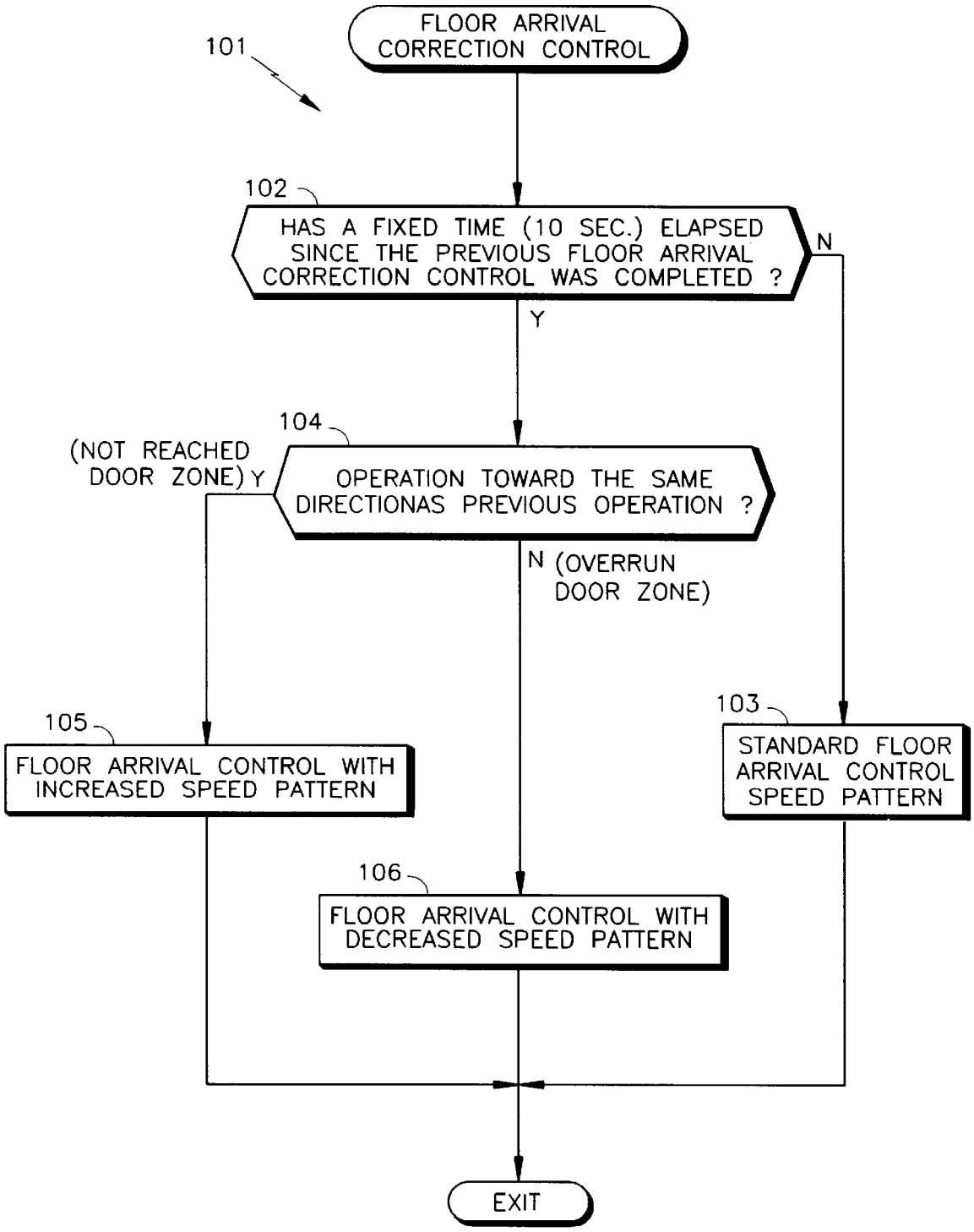
FIG. 4 is a flow chart illustrating a floor arrival correction control procedure in accordance with the present invention.

Referring to FIGS. 2 and 4, the door zone/floor arrival control logic (22) portion of the controller (10) of the present invention includes a counter that records the time duration from the end of the previous floor arrival correction operation and a register that records the direction of operation of the previous floor arrival correction operation for the current floor attempting to be arrived at by the elevator car. When the outputs of both door zone sensors DZU,DZD are not both on (i.e., the car has not reached the DZU/DZD overlapped position or the "door zone") at the end of the deceleration phase of the elevator, the door zone/floor arrival control operation unit (22) (FIG. 2) begins the floor arrival correction control logic (101) (FIG. 4).

Figure 5:
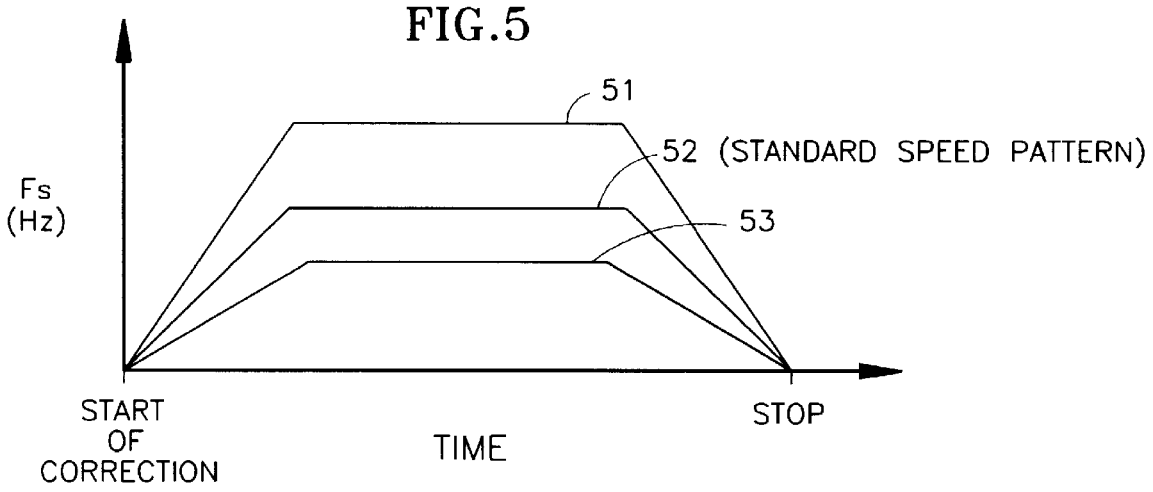
FIG. 5 is a block diagram illustrating a speed pattern in accordance with the present invention.

When the floor arrival correction control logic (101) is started, a step (102) determines whether the time that has elapsed from the time of the start of the previous floor arrival correction operation for the current floor attempting to be arrived at (as detected by the aforementioned counter) is within a prescribed time (e.g., 10 sec) (102). If the result of step (102) is no, then operation has not entered the mode of repeated floor arrival correction operation (i.e., this is the first time floor arrival correction has been invoked for this floor) and the standard floor arrival correction operation is carried out as indicated by a step (103) according to a standard speed pattern (52) (FIG. 5).

On the other hand, when the result of step (102) is yes, or, as a result of performing the aforementioned standard floor arrival correction control, the floor arrival correction operation is restarted, and the judgment result of (102) becomes yes, step (104) determines whether the direction of operation is the same as the direction of operation recorded on the aforementioned register. If the result of step (104) is yes, that is, if this is a repetition of the previous correction operation in the same direction, the load of the car is heavy, hence the floor arrival correction control is carried out using a pattern (51) (FIG. 5) which is faster than the standard pattern, as indicated by a step (105) (FIG. 4). However, if the result in step (104) is no, i.e., the correction operation is repeated in the direction opposite to the direction in the previous operation, the door zone is overrun, the load of the car is light, and the floor arrival correction control is carried out using a speed pattern (53) (FIG. 5) which is slower than the standard pattern, as indicated by a step (106) (FIG. 4).

Thus, upon detection that the car has not reached the door zone after the prescribed time from the start of the floor arrival correction operation, the speed pattern is increased, the frequency instruction is increased, and the car with a heavy load is driven to move; and upon detection that the car has overrun the door zone, the speed pattern is reduced.

As the floor arrival correction is carried out in the aforementioned procedure, although no strict speed detection is performed, it is still possible to finish the floor arrival correction control within two rounds of operation. Also, it is possible to avoid the phenomenon of no movement when the load is heavy, and it is possible to avoid the phenomenon of multiple repetitions when the load is light.

Figure 6:
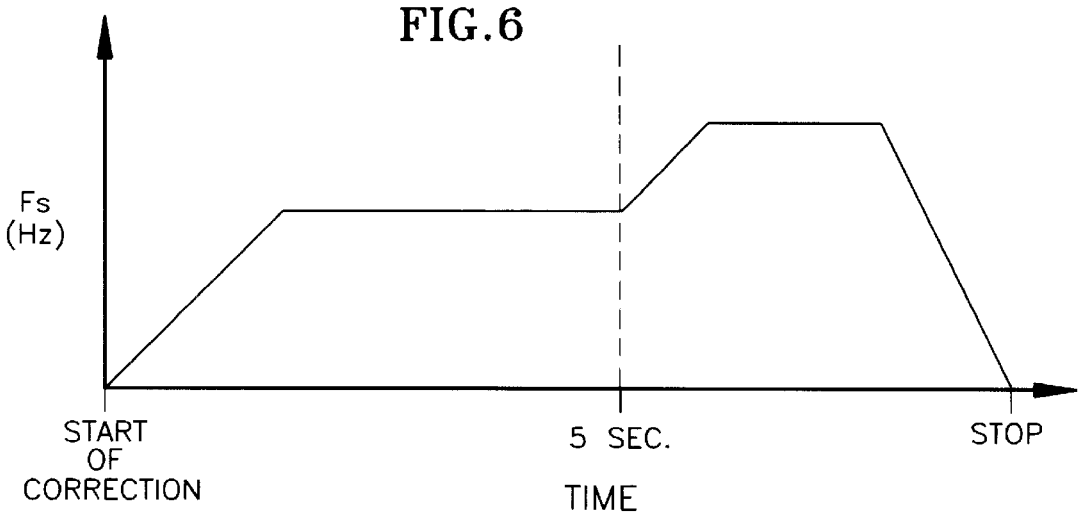
FIG. 6 is a block diagram illustrating an example of a speed pattern in accordance with another embodiment of the present invention.
Figure 7:
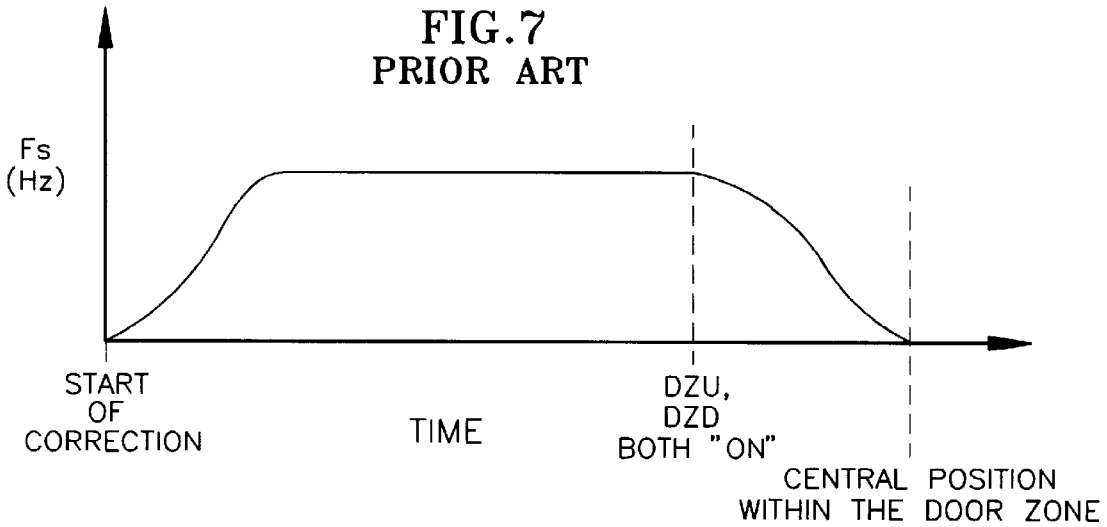
FIG.7 PRIOR ART
FIG. 7 is a diagram illustrating a prior art speed pattern for floor arrival control.

Referring to FIG. 6, in another embodiment of the present invention, in addition to the control described in of FIG. 5, when the load is heavy, the speed profile control shown in FIG. 6 may be carried out. As shown in FIG. 6, after a predetermined time (for example, 5 sec) from the start of the floor arrival correction operation, the outputs of sensors DZU and DZD are monitored. If they are not both on, it is determined that the car has not moved, so that the frequency command Fs is increased to have the car operate sufficiently. In this way, it is possible to perform the floor arrival correction control without retrying the correction operation. Thus, the speed pattern of FIG. 6 allows for a reduced number of retries.

Although the invention has been described and illustrated with respect to exemplary embodiments thereof, it should be understood by those skilled in the art that the foregoing, and various other changes, omissions and additions may be made without departing from the spirit and scope of the present invention.

What is claimed is:

1. A method of providing elevator floor arrival correction control, comprising the steps of:

a) controlling the elevator with a first floor arrival correction speed pattern until a predetermined wait time has elapsed;

b) controlling the elevator with a second floor arrival correction speed pattern when the direction required for floor correction is the same as in the previous floor arrival correction;

c) controlling the elevator with a third floor arrival correction speed pattern when the direction required for floor correction is not the same as in the previous floor arrival correction; and d) repeating steps b) and c) successively until the elevator is in a door zone at the destination floor.

2. The method of claim 1 wherein said second speed pattern controls the elevator at a faster speed than said first speed pattern.

3. The method of claim 1 wherein said third speed pattern controls the elevator at a slower speed than said first speed pattern.

4. The method of claim 1 wherein said predetermined wait time is ten (10) seconds.

5. The method of claim 1 wherein said second speed pattern comprises an increased speed region when the elevator is not in the door zone at the destination floor within a predetermined arrival time.

6. The method of claim 5 wherein said predetermined arrival time is five (5) seconds.

* * * * *